US009513034B2

(12) United States Patent
Lee et al.

(10) Patent No.: US 9,513,034 B2
(45) Date of Patent: Dec. 6, 2016

(54) MULTI-TYPE AIR CONDITIONER

(75) Inventors: Suk Ho Lee, Gyeonggi-do (KR); Min Chang, Gyeonggi-do (KR)

(73) Assignee: SAMSUNG ELECTRONICS CO., LTD., Suwon-Si (KR)

( * ) Notice: Subject to any disclaimer, the term of this patent is extended or adjusted under 35 U.S.C. 154(b) by 604 days.

(21) Appl. No.: 13/550,901

(22) Filed: Jul. 17, 2012

(65) Prior Publication Data

US 2013/0019613 A1 Jan. 24, 2013

(30) Foreign Application Priority Data

Jul. 18, 2011 (KR) ..... 10-2011-0071185

(51) Int. Cl.

| | |
|---|---|
| ***F25B 41/00*** | (2006.01) |
| ***F25B 41/04*** | (2006.01) |
| ***F25B 13/00*** | (2006.01) |
| *F25B 6/04* | (2006.01) |
| *F25B 40/06* | (2006.01) |
| *F25B 40/00* | (2006.01) |
| *F25B 40/02* | (2006.01) |

(52) U.S. Cl.

CPC ..... *F25B 13/00* (2013.01); *F25B 6/04* (2013.01); *F25B 40/00* (2013.01); *F25B 40/02* (2013.01); *F25B 40/06* (2013.01); *F25B 2313/007* (2013.01); *F25B 2313/0231* (2013.01)

(58) Field of Classification Search

CPC ..... F25B 40/00; F25B 40/02; F25B 40/06; F25B 6/04

USPC ..... 62/113, 225, 513

See application file for complete search history.

(56) References Cited

U.S. PATENT DOCUMENTS

2004/0139755 A1* 7/2004 Han Park et al. ..... 62/199
2005/0160763 A1* 7/2005 Choi ..... F25B 13/00 62/513
2006/0137381 A1* 6/2006 Choi ..... F25B 13/00 62/324.1

(Continued)

FOREIGN PATENT DOCUMENTS

CN 1796905 7/2006
JP WO 2010082325 A1 * 7/2010 ..... F25B 13/00

(Continued)

OTHER PUBLICATIONS

Chinese Office Action dated Sep. 11, 2015 from Chinese Patent Application No. 201210249272.6, 18 pages.

*Primary Examiner* — Ryan J Walters
*Assistant Examiner* — Steve Tanenbaum
(74) *Attorney, Agent, or Firm* — Staas & Halsey LLP

(57) ABSTRACT

A multi-type air conditioner includes an outdoor unit disposed at an exterior space, a plurality of indoor units disposed at interior spaces, and a mode conversion unit connected to the outdoor unit and the plurality of indoor units through refrigerant pipes to circulate a refrigerant between the outdoor unit and the plurality of indoor units. The mode conversion unit includes a plurality of subcooling units which are configured to subcool a refrigerant before the refrigerant is introduced to the plurality of indoor units, using a subcooling refrigerant pipe which sequentially passes through at least one of the plurality of subcooling units, so that a refrigerant after having passed through the subcooling unit, is in a state of pure gas while ensuring a desired subcooling degree that is suitable for each indoor unit.

20 Claims, 2 Drawing Sheets

(56) References Cited

U.S. PATENT DOCUMENTS

| | | | | |
|---|---|---|---|---|
| 2010/0043467 | A1* | 2/2010 | Kawano | F25B 13/00 62/129 |
| 2011/0232308 | A1* | 9/2011 | Morimoto | F25B 13/00 62/132 |

FOREIGN PATENT DOCUMENTS

| | | |
|---|---|---|
| KR | 10-2005-0118451 | 12/2005 |
| KR | 10-0702218 | 3/2007 |
| KR | 10-0733295 | 6/2007 |

* cited by examiner

MULTI-TYPE AIR CONDITIONER

CROSS-REFERENCE TO RELATED APPLICATIONS

This application claims the benefit of Korean Patent Application No. 10-2011-0071185, filed on Jul. 18, 2011, in the Korean Intellectual Property Office, the disclosure of which is incorporated herein by reference.

BACKGROUND

1. Field

Embodiments disclosed herein relate to a multi-type air conditioner capable of simultaneously performing a cooling operation and a heating operation.

2. Description of the Related Art

In general, a multi-type air conditioner may include an outdoor unit and a plurality of indoor units connected to the outdoor unit. A refrigerant transferred from the outdoor unit is distributed to the plurality of indoor units such that a cooling operation and a heating operation are independently performed at each indoor space.

The outdoor unit may include a compressor to compress a refrigerant, an outdoor heat exchanger to exchange heat with outdoor air, an outdoor expansion valve to expand the refrigerant under decompression before the refrigerant is introduced into the outdoor heat exchanger during a heating operation, and a four-way valve to guide the refrigerant discharged to one of the plurality of indoor units and the outdoor heat exchanger. Each one of the plurality of indoor units may include an indoor heat exchanger to exchange heat with indoor air, and an indoor expansion valve to expand the refrigerant under decompression before the refrigerant is introduced into the indoor heat exchanger during a cooling operation. Such a configuration of the multi-type air conditioner enables the cooling operation and the heating operation to be selectively converted.

In a multi-type air conditioner which is provided with a conversion unit, the conversion unit may be provided between the outdoor unit and the indoor unit to deliver the refrigerant from the outdoor unit to the indoor unit or from the indoor unit to the outdoor unit such that an indoor unit performs a cooling operation while another indoor unit performs a heating operation.

In addition, the multi-type air conditioner may include a plurality of subcooling units which are each configured to subcool the refrigerant introduced to the indoor heat exchanger during a cooling operation, thereby reducing noise generated in the course of passing refrigerant through the indoor expansion valve.

SUMMARY

Therefore, it is an aspect of the present disclosure to provide a multi-type air conditioner capable of preventing a refrigerant passing through a subcooling unit from failing to be overheated into a state of pure gas after a heat exchange with refrigerant being delivered to the indoor unit, while ensuring a desired subcooling degree that is suitable for each indoor unit using refrigerant which is delivered to an indoor heat exchanger after the heat exchange with the refrigerant passing through the subcooling unit.

Additional aspects of the disclosure will be set forth in part in the description which follows and, in part, will be obvious from the description, or may be learned by practice of the disclosure.

In accordance with one aspect of the present disclosure, a multi-type air conditioner includes an outdoor unit, a plurality of indoor units and a mode conversion unit. The outdoor unit may be disposed at an exterior space. The plurality of indoor units may be disposed at interior spaces. The mode conversion unit may be connected to the outdoor unit and the plurality of indoor units through refrigerant pipes to deliver a refrigerant, which has been delivered from one of the outdoor unit and the plurality of indoor units to another one of the outdoor unit and the plurality of indoor units. The mode conversion unit may include a plurality of subcooling units, a subcooling refrigerant pipe, and a subcooling expansion valve. The plurality of subcooling units, during a cooling operation, are configured to subcool a refrigerant of a low temperature before the refrigerant of lower temperature is introduced to the plurality of indoor units. The subcooling refrigerant pipe sequentially passes through at least one of the plurality of subcooling units. The subcooling expansion valve may be disposed on the subcooling refrigerant pipe to expand a refrigerant under decompression before the refrigerant is introduced into the plurality of subcooling units.

The outdoor unit may include a compressor to compress a refrigerant, an outdoor heat exchanger to exchange heat with outdoor air, and an outdoor heat expansion valve, which during a heating operation expands a refrigerant under decompression before the refrigerant is introduced into the outdoor heat exchanger. Each of the plurality of indoor units may include an indoor heat exchanger configured to exchange heat with indoor air, and an indoor expansion valve, which during a cooling operation, expands a refrigerant under decompression before the refrigerant is introduced into the indoor heat exchanger.

The refrigerant pipes may include a first refrigerant pipe, a second refrigerant pipe and a third refrigerant pipe. The first refrigerant pipe is configured to deliver a refrigerant of high temperature discharged from the compressor to the indoor heat exchangers. The second refrigerant pipe is configured to guide a refrigerant, which has absorbed heat at the indoor heat exchanger, to the compressor during a cooling operation. The third refrigerant pipe is configured to guide a refrigerant, which has emitted heat in at least one of the outdoor heat exchanger and the indoor heat exchangers, to another one of the outdoor heat exchanger and the indoor heat exchangers. The subcooling refrigerant pipe branches from the third refrigerant pipe and sequentially passes through at least one of the plurality of subcooling units and joins the second refrigerant pipe.

The multi-type air conditioner further includes a plurality of first branch refrigerant pipes connected to the third refrigerant pipe, which during the cooling operation, distributes the refrigerant, which is delivered through the third refrigerant pipe, into the plurality of indoor heat exchangers. The subcooling unit is configured to allow a refrigerant, which passes through the first branch refrigerant pipe, to exchange heat with a refrigerant, which passes through the subcooling refrigerant pipe.

The mode conversion unit further includes a cooling valve and a heating valve. The cooling valve, during a cooling operation, is configured to allow a refrigerant, which has passed through the indoor heat exchanger, to be delivered to the second refrigerant pipe. The heating valve, during a heating operation, is configured to allow a refrigerant, which has passed through the first refrigerant pipe, to be delivered to the indoor heat exchanger.

The multi-type air conditioner further includes a four-way valve, a fourth refrigerant pipe, a heating bypass refrigerant pipe and a heating bypass valve. The four-way valve is configured to guide a refrigerant, which has been discharged from the compressor, to one of the outdoor heat exchanger and the plurality of indoor units. The fourth refrigerant pipe connects the four-way valve to the outdoor heat exchanger. The heating bypass refrigerant pipe connects the first refrigerant pipe to the fourth refrigerant pipe. The heating bypass valve is configured to open and close the heating bypass refrigerant pipe as needed.

The multi-type air conditioner may further include an outdoor expansion valve and an indoor expansion valve. The outdoor expansion valve is disposed on the outdoor unit, and during a heating operation, expands a refrigerant under decompression before the refrigerant is introduced into the outdoor heat exchanger. The indoor expansion valve is disposed on each of the indoor units, and during a cooling operation, expands a refrigerant under decompression before the refrigerant is introduced into the indoor heat exchanger.

In accordance with another aspect of the present disclosure, a multi-type air conditioner includes an first unit, a plurality of second units, and a plurality of subcooling units. The first unit includes an first heat exchanger disposed on an exterior space to exchange heat with air. The plurality of second units are connected to the first unit through refrigerant pipes, and include second heat exchangers, respectively, to exchange heat with air. The plurality of subcooling units are configured to subcool a refrigerant, which is introduced into the second heat exchangers, respectively, during a cooling operation. The refrigerant pipes include a first refrigerant pipe, a second refrigerant pipe, a third refrigerant pipe, and a subcooling refrigerant pipe. The first refrigerant pipe is configured to deliver a refrigerant of high temperature, which is discharged from a compressor, to the second heat exchangers. The second refrigerant pipe is configured to guide a refrigerant, which has absorbed heat at the second heat exchanger, to the compressor during a cooling operation. The third refrigerant pipe is configured to guide a refrigerant, which has emitted heat in at least one of the first heat exchanger and the second heat exchangers, to another one of the first heat exchanger and the second heat exchangers. The subcooling refrigerant pipe branches from the third refrigerant pipe and sequentially passes through at least one of the plurality of subcooling units. The multi-type air conditioner further includes a subcooling expansion valve disposed on the subcooling refrigerant pipe to expand a refrigerant, which is introduced to the subcooling unit, under decompression.

The multi-type air conditioner further includes a plurality of first branch refrigerant pipes connected to the third refrigerant pipe to distribute the refrigerant, which is delivered through the third refrigerant pipe, into the plurality of second heat exchangers, during the cooling operation. The subcooling unit is configured to allow a refrigerant, which passes through the first branch refrigerant pipe, to exchange heat with a refrigerant passing through the subcooling refrigerant pipe.

In accordance with another aspect of the present disclosure, a method of controlling refrigerant circulation during a cooling operation in a multi-type air includes receiving, by a mode-conversion unit from an external unit via a refrigerant pipe, a refrigerant in a mixed state of liquid and gas during a cooling operation. The method may further include expanding the refrigerant under decompression, by using a subcooling expansion valve disposed on a subcooling refrigerant pipe connected to the refrigerant pipe. The method may further include subcooling a refrigerant passing through a first branch pipe among a plurality of first branch pipes which connect the refrigerant pipe to a plurality of internal units, to a state of liquid, via a heat exchange with the subcooling refrigerant pipe. The method may further include heating refrigerant passing through the subcooling refrigerant pipe, via a heat exchange with the first branch pipe among the plurality of first branch pipes, wherein the expanding may be performed before the subcooled refrigerant is introduced to the plurality of internal units.

As described above, a subcooling refrigerant pipe sequentially passes through at least one of the plurality of subcooling units, so that a refrigerant moving along the subcooling refrigerant pipe proceeds past a subcooling unit corresponding to the an indoor unit at a non-operation state (e.g., an indoor unit not engaged in a cooling operation) and then is used to absorb heat at the next subcooling unit which is in an operating state (e.g., an indoor unit engaged in a cooling operation). Accordingly, the refrigerant passing through the subcooling units is prevented from failing to be overheated into a state of pure gas while ensuring a desired subcooling degree or temperature that is suitable for each indoor unit.

BRIEF DESCRIPTION OF THE DRAWINGS

These and/or other aspects of the disclosure will become apparent and more readily appreciated from the following description of the embodiments, taken in conjunction with the accompanying drawings of which.

DETAILED DESCRIPTION

Figure 1:
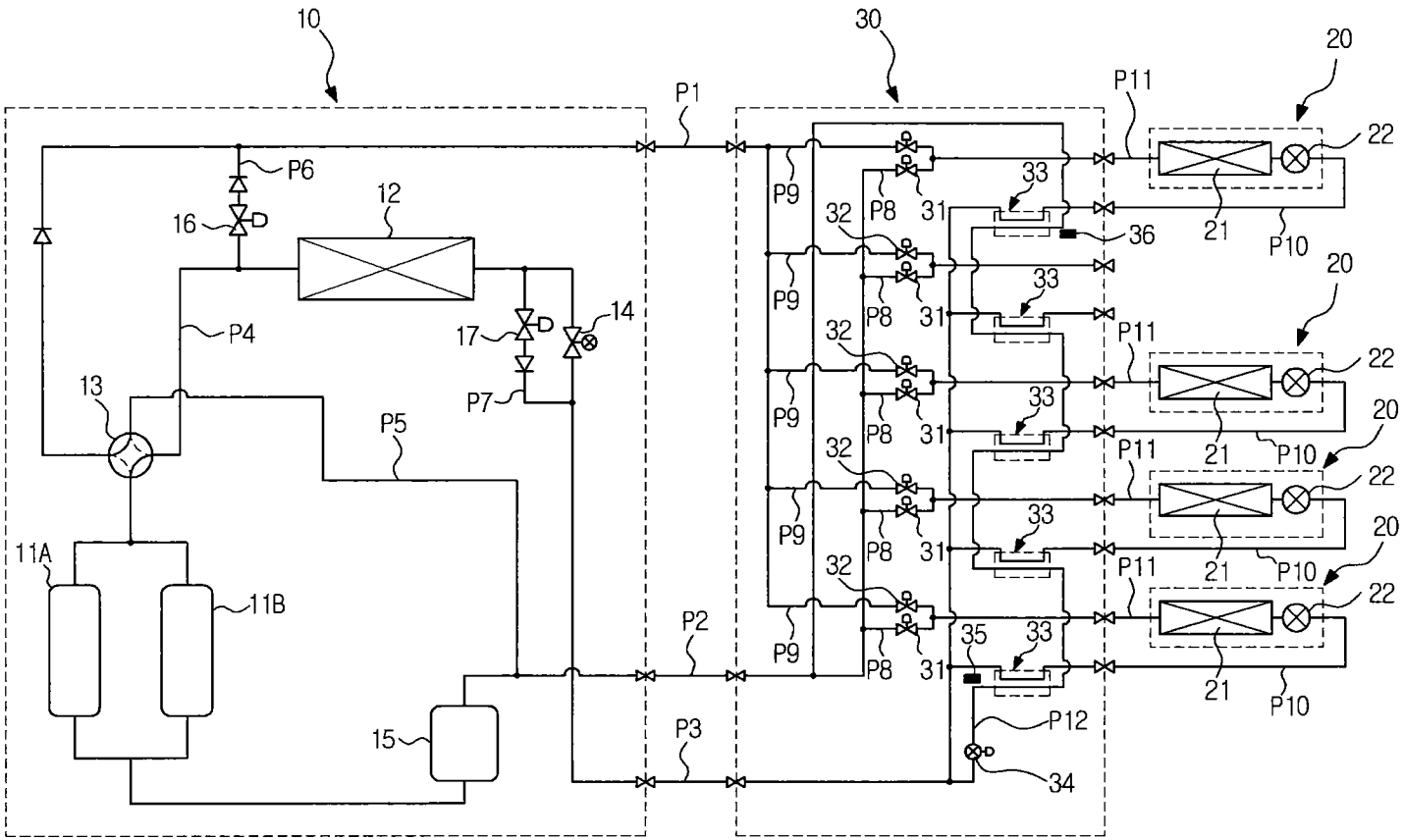
FIG. 1 is a schematic view illustrating the configuration of a multi-type air conditioner according to an embodiment of the present disclosure.

Reference will now be made in detail to the embodiments of the present disclosure, examples of which are illustrated in the accompanying drawings, wherein like reference numerals refer to like elements throughout.

A multi-type air conditioner according to an embodiment of the present disclosure includes an outdoor unit 10 disposed at an exterior space, a plurality of indoor units 20 disposed in a plurality of interior spaces, respectively, to independently heat and cool the interior spaces, and a mode conversion unit 30 disposed between the outdoor unit 10 and the plurality of indoor units 20 and connected to the outdoor unit 10 and the plurality of indoor units 20 through refrigerant pipes to selectively deliver a refrigerant, which is delivered from one of the outdoor unit 10 and the plurality of indoor units 20, to another one of the outdoor unit 10 and the plurality of indoor units 20 such that a cooling operation or a heating operation is selectively performed on the plurality of indoor units 20.

The outdoor unit 10 may include compressors 11A and 11B to compress a refrigerant, an outdoor heat exchanger 12 to exchange a heat with outdoor air, and a four-way valve 13 to selectively guide the refrigerant, which is discharged from the compressors 11A and 11B, to one of the outdoor unit 10 and the plurality of indoor units 20. The outdoor unit 10 may further include an outdoor expansion valve 14 to expand the refrigerant which is guided to the outdoor heat exchanger 12 under decompression during a heating operation. The outdoor unit 10 may further include an accumulator 15 to prevent the refrigerant in a state of liquid from being introduced to the compressors 11A and 11B, by capturing and removing any liquid which may remain in the refrigerant. Each of the indoor units 20 includes an indoor heat exchanger 21 to exchange heat with indoor air and an indoor expansion valve 22 to expand the refrigerant, which is introduced to the indoor heat exchanger 21, under decompression during a cooling operation. A fan or blower (not shown) may be disposed in each of the indoor units to circulate warm air in the corresponding indoor unit across the indoor heat exchanger 21 in which the refrigerant passes through during a cooling operation, such that the warm air evaporates the liquid part of the refrigerant.

The compressors 11A and 11B include a pair of compressors 11A and 11B that are connected in parallel to each other to flexibly correspond to a cooling load and a heating load required for a cooling operation and a heating operation. Each of the outdoor expansion valve 14 and the indoor expansion valve 22 is implemented by an electronic expansion valve that adjusts an opening degree such that the refrigerant, which passes through the outdoor expansion valve 14 and the indoor expansion valve 22, are selectively expanded under decompression.

The respective components are connected to each other through the refrigerant pipes to circulate the refrigerant. The refrigerant pipes include a first refrigerant pipe P1, a second refrigerant pipe P2, a third refrigerant pipe P3, a fourth refrigerant pipe P4, and a fifth refrigerant pipe P5. The first refrigerant pipe P1 connects the four-way valve 13 to the indoor heat exchangers 21 to deliver the refrigerant of high temperature discharged from the compressors 11A and 11B to the indoor heat exchangers 21. The second refrigerant pipe P2 connects the indoor heat exchangers 21 to the compressors 11A and 11B such that the refrigerant, which has absorbed heat at the indoor heat exchanger 12, is guided to the compressors 11A and 11B during the cooling operation. The third refrigerant pipe P3 connects the outdoor heat exchanger 12 to the indoor heat exchangers 21 such that the refrigerant, which has emitted heat at one heat exchanger of the outdoor heat exchanger 12 and the indoor heat exchangers 21, is guided to another one of the outdoor heat exchanger 12 and the indoor heat exchangers 21. The fourth refrigerant pipe P4 connects the four-way valve 13 to the outdoor heat exchanger 12 to deliver a refrigerant of high temperature to the outdoor heat exchanger 12. The fifth refrigerant pipe P5 connects the four-way valve 13 to the second refrigerant pipe P2 such that the refrigerant, which has been delivered from the outdoor heat exchanger 12 through the four-way valve 13, is guided to the compressors 11A and 11B through the second refrigerant pipe P2.

In addition, a heating bypass refrigerant pipe P6 may be provided between the first refrigerant pipe P1 and the fourth refrigerant pipe P4 to connect the first refrigerant pipe P1 to the fourth refrigerant pipe P4. Accordingly, if a heating operation is performed with a heating load smaller than a cooling load, a part of the refrigerant, which is to be delivered to the outdoor heat exchanger 12 through the fourth refrigerant pipe P4, is delivered to a certain indoor heat exchanger 21 through the first refrigerant pipe P1 such that a heating operation is performed on the certain indoor heat exchanger 21. A heating bypass valve 16 may be disposed on the heating bypass refrigerant pipe P6 to selectively open and close the heating bypass refrigerant pipe P6 according to the determination regarding whether the heating load is smaller than the cooling load during the heating operation.

The outdoor expansion valve 14 is disposed on the third refrigerant pipe P3. The refrigerant pipes include a cooling bypass refrigerant pipe P7 that allows the refrigerant to detour around the outdoor expansion valve 14 during a cooling operation. A cooling bypass valve 17 is disposed on the cooling bypass refrigerant pipe P7 to selectively open and close the cooling bypass refrigerant pipe P7.

The mode conversion unit 30 may include a plurality of cooling refrigerant pipes P8, a plurality of heating refrigerant pipes P9, cooling valves 31, and heating valves 32. The plurality of cooling refrigerant pipes P8 connect the second refrigerant pipe P2 to the plurality of indoor heat exchangers 21 such that a refrigerant passing through the indoor heat exchanger 21 is delivered to the compressors 11A and 11B through the second refrigerant pipe P2 during a cooling operation. The plurality of heating refrigerant pipes P9 connect the first refrigerant pipe P1 to the plurality of indoor heat exchangers 21 such that the refrigerant delivered from the compressors 11A and 11B is delivered to the indoor heat exchanger 21 through the first refrigerant pipe P1 during a heating operation. The cooling valves 31 are disposed on the cooling refrigerant pipes P8, respectively, such that a cooling operation is selectively performed at a certain indoor unit 21 corresponding to a respective cooling refrigerant pipe P8. The heating valves 32 are disposed on the heating refrigerant pipes P9, respectively such that a heating operation is selectively performed at a certain indoor unit 21 corresponding to a respective heating refrigerant pipe P9. One of the cooling valves 31 and one of the heating valves 32 are connected to one of the indoor units 20 while forming a pair of values in a manner such that a plurality of pairs of valves are provided to correspond to the plurality of indoor units 20. For example, when eight pairs of valves are provided (including eight cooling valves 31 and eight heating valves 32), then eight indoor units 20 correspond to the eight pairs of valves.

In addition, the refrigerant pipes include a plurality of first branch refrigerant pipes P10 and a plurality of second branch refrigerant pipes P11. The plurality of first branch refrigerant pipes P10 branch from the third refrigerant pipe P3 such that a refrigerant is distributed into the plurality of indoor heat exchangers 21 during a cooling operation. The plurality of second branch refrigerant pipes P11 enable the indoor heat exchangers 21 each to be connected to one cooing refrigerant pipe P8 and one heating refrigerant pipe P9. The indoor expansion valve 22 is disposed on the first branch refrigerant pipe P10.

The mode conversion unit 30 includes a subcooling unit 33, during a cooling operation, configured to subcool the refrigerant, which is delivered from the outdoor heat exchanger 12, before the refrigerant is introduced into the indoor unit 20, thereby preventing a refrigerant in a state of gas from being introduced into the indoor expansion valve 22.

The subcooling unit 33 is provided with a plurality of subcooling units 33 to subcool the refrigerant introduced to the respective indoor unit 20. The subcooling units 33 are configured to subcool the refrigerant passing through the first branch refrigerant pipes P10. The mode conversion unit 30 includes a subcooling refrigerant pipe P12 and a subcooling expansion valve 34. In order to subcool a refrigerant passing through the first branch refrigerant pipe P10 at the subcooling units 33, the subcooling refrigerant pipe P12 branches from the third refrigerant pipe and joins the second refrigerant pipe P2 after passing through the subcooling units 33. The subcooling expansion valve 34 is disposed on the subcooling refrigerant pipe P12 to expand the refrigerant under decompression before the refrigerant is introduced into the subcooling units 33. That is, the first branch refrigerant pipe P10 exchanges heat with the subcooling refrigerant pipe P12 at the subcooling units 33 such that a refrigerant passing through the first branch refrigerant pipe P10 is subcooled by a refrigerant passing through the subcooling refrigerant pipe P12, and a refrigerant passing through the subcooling refrigerant pipe P12 is heated by a refrigerant passing through the first branch refrigerant pipe P10.

Accordingly, the refrigerant delivered from the outdoor heat exchanger 12 is expanded under a decompression by passing through the subcooling expansion valve 34. Thereafter, the refrigerant expanded under the decompression absorbs heat from the refrigerant passing through the first branch refrigerant pipe P10 while passing through the subcooling units 33 along the subcooling refrigerant pipe P12. Accordingly, a refrigerant passing through the first branch refrigerant pipe P10 is subcooled by passing through the subcooling units 33, before the refrigerant is introduced into the indoor expansion valve 22 of the indoor unit 20.

According to the embodiment of the present disclosure, the subcooling refrigerant pipe P12 sequentially passes through the plurality of subcooling units 33 to subcool each refrigerant introduced into the indoor units 20. In a state that the subcooling refrigerant pipe P12 sequentially passes through the subcooling units 33, if a certain indoor unit 20 does not operate, or is not performing a cooling operation, a heat exchange is not performed at a certain subcooling unit 33 corresponding to the certain indoor unit 20, and the refrigerant is directly delivered to the next subcooling unit 33 along the subcooling refrigerant pipe P12 and is used for absorbing heat of the refrigerant passing through the first branch refrigerant pipe P10 at the next subcooling unit 33. In this manner, a refrigerant is not provided for absorbing heat at a certain subcooling unit 33 corresponding to the indoor unit 20 that has stopped operating, or is not performing a cooling operation, thereby enhancing the efficiency of the multi-type air conditioner.

In addition, the mode conversion unit 30 includes at least one temperature sensor to measure the temperature of the refrigerant passing through the subcooling unit 33. The temperature sensor may include a first temperature sensor 35, which is configured to measure the temperature of the refrigerant introduced into a certain subcooling unit 33 corresponding to the upmost stream of the subcooling refrigerant pipe P12 among the subcooling units 33, and a second temperature sensor 36 to measure the temperature of the refrigerant introduced into a certain subcooling unit 33 corresponding to the downmost stream of the subcooling refrigerant pipe P12 among the subcooling units 33. Accordingly, it is checked whether the refrigerant is in a mixed state of gas and liquid, or in a state of pure gas by measuring the temperature of the refrigerant passing through the subcooling refrigerant pipe P12 through the first temperature sensor 35 and the second temperature sensor 36. Thereafter, an opening degree of the subcooling expansion valve 34 is adjusted such that the refrigerant in a state of liquid is prevented from being introduced into the compressors 11A and 11B. Accordingly, the refrigerant passing through the subcooling unit 33 is prevented from failing to be overheated to a gas state, and a subcooling degree (temperature) suitable for each indoor unit 20 is ensured. In other words, a refrigerant having passed through the subcooling refrigerant pipe P12 and having been heated by a refrigerant passing through at least one first branch refrigerant pipe P10, is suitably heated to a gas state. Therefore, when the subcooling refrigerant pipe P12 joins the second refrigerant pipe P2 after passing through the subcooling unit 33, the refrigerant introduced to the compressors 11A and 11B is in a state of pure gas and does not contain liquid.

Likewise, a refrigerant having passed through the first branch refrigerant pipe P10 and having been subcooled by a refrigerant passing through the subcooling refrigerant pipe P12, is suitably subcooled to a liquid state when it is introduced to the indoor expansion valve 22 of the indoor unit 20. Furthermore, refrigerant passing through the indoor heat exchanger 21 is delivered to the compressors 11A and 11B in a state of pure gas, via the second refrigerant pipe P2 and the cooling refrigerant pipes P8.

Figure 2:
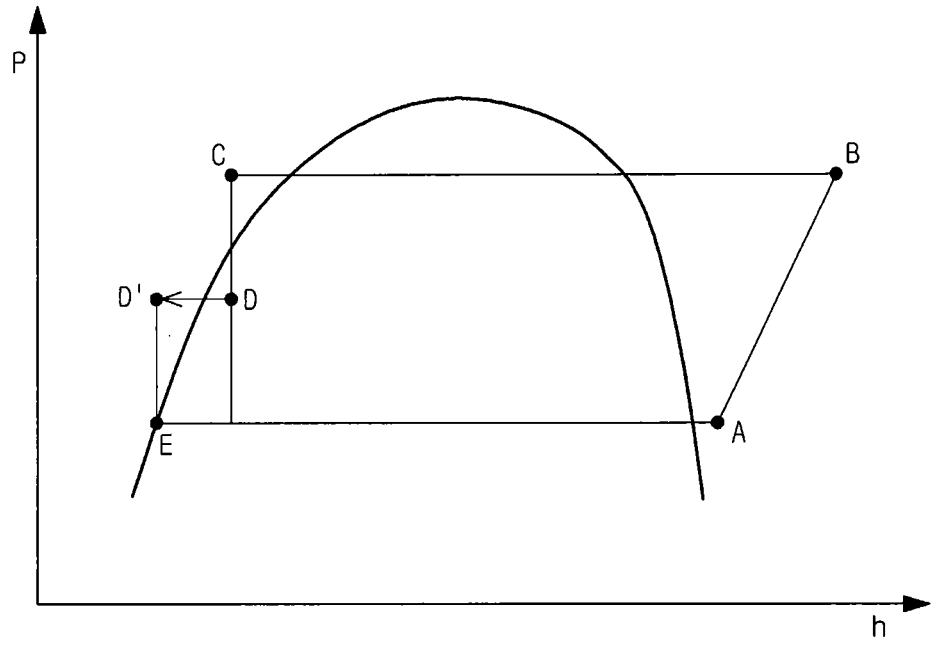
FIG. 2 is a pressure—enthalpy (P-h) thermodynamic line diagram of the multi-type air conditioner according to the embodiment of the present disclosure.

Hereinafter, the operation of a multi-type air conditioner according to an embodiment of the present disclosure will be described with reference to FIGS. 1 and 2.

First, when a refrigerant is compressed by the compressors 11A and 11B, the pressure and the enthalpy of the refrigerant are gradually increased (A→B). A part of the refrigerant of high temperature discharged from the compressors 11A and 11B to the fourth refrigerant pipe P4 is delivered to some of the indoor heat exchangers 21 through the heating bypass refrigerant pipe P6 such that some indoor units 20 corresponding to the indoor heat exchangers 21 perform a heating operation. The refrigerant is cooled while exchanging heat with the indoor air of the indoor heat exchanger, in which the heating operation is being proceeded, and thus the enthalpy of the refrigerant is decreased (B→C). The refrigerant cooled at the indoor heat exchanger 21 is decompressed by the indoor expansion valve 22. In this case, if the subcooling degree of the refrigerant is small or the degree of decompression of the refrigerant is large, the refrigerant is in a mixed state of liquid and gas (C→D).

Meanwhile, most of the refrigerant discharged from the compressors 11A and 11B is delivered to the outdoor heat exchanger through the fourth refrigerant pipe P4, and then is cooled by passing through the outdoor heat exchanger 12. The cooled refrigerant is delivered to the indoor heat exchanger 21 in a cooling operation through the third refrigerant pipe P3 and the first branch refrigerant pipe P10, and is used to cool an interior space corresponding to the indoor heat exchanger 21.

A part of the refrigerant having passed through the third refrigerant pipe P3 passes through the subcooling unit 33 along the subcooling refrigerant pipe P12. At this time, a refrigerant in a mixed state of liquid and gas (D) is cooled by the refrigerant passing through the subcooling unit 33 along the subcooling refrigerant pipe P12, and then is turned into a state of liquid (D→D'). The refrigerant in the state of liquid is delivered to the indoor unit 20 in a cooling operation through the first branch refrigerant pipe P10 that is connected to the indoor unit 20, and is used for the cooling operation.

Although the subcooling refrigerant pipe P12 is configured to pass through all of the plurality of subcooling units 33, the present disclosure is not limited thereto. According to another embodiment of the present disclosure, the subcooling refrigerant pipe P12 passes through some of the plurality of subcooling units 33.

Although the temperature sensor includes the first temperature sensor 35 and the second temperature sensor 36, the present disclosure is not limited thereto. According to another embodiment of the present disclosure, the multi-type air conditioner includes only one temperature sensor used to measure the temperature of a refrigerant discharged from a certain subcooling unit 33 corresponding to the downmost stream of the subcooling refrigerant pipe P12 among the subcooling units 33. The temperature of the refrigerant finally discharged after passing through all of the subcooling units 33 is measured, and the opening degree of the subcooling expansion valve is adjusted based on the measured temperature. Alternatively, a temperature sensor may be disposed in each of the subcooling units 33, and a temperature may be obtained from each of the subcooling units 33, the upmost and downmost subcooling units 33 in which the indoor units operate, or only from the downmost subcooling unit 33 in which the indoor unit operates.

Although a few example embodiments of the present disclosure have been shown and described, it would be appreciated by those skilled in the art that changes may be made in these embodiments without departing from the principles and spirit of the disclosure, the scope of which is defined in the claims and their equivalents.

What is claimed is:

1. A multi-type air conditioner comprising:

an outdoor unit disposed at an exterior space;

a plurality of indoor units disposed at interior spaces; and a mode conversion unit connected to the outdoor unit and the plurality of indoor units through refrigerant pipes used to circulate the refrigerant between the outdoor unit and the plurality of indoor units, wherein the mode conversion unit comprises:

a plurality of subcooling units, configured to subcool a refrigerant before the refrigerant is introduced to the plurality of indoor units;

a subcooling refrigerant pipe to connect the plurality of subcooling units in series; and a subcooling expansion valve disposed on the subcooling refrigerant pipe to expand a refrigerant before the refrigerant is introduced into the plurality of subcooling units, wherein the refrigerant pipes comprise:

a first refrigerant pipe configured to deliver a refrigerant between the outdoor unit and the plurality of indoor units, a second refrigerant pipe configured to guide a refrigerant from the plurality of indoor units to the outdoor unit, a third refrigerant pipe configured to guide a refrigerant, which has emitted heat in at least one of an outdoor heat exchanger disposed in the outdoor unit and indoor heat exchangers respectively disposed in the plurality of indoor units, to another one of the outdoor heat exchanger and the indoor heat exchangers, and a plurality of first branch refrigerant pipes which branch from the third refrigerant pipe, to distribute the refrigerant, which is delivered through the third refrigerant pipe, into respective indoor heat exchangers, wherein the subcooling refrigerant pipe branches from the third refrigerant pipe at a point before the plurality of first branch refrigerant pipes branch from the third refrigerant pipe, connects the plurality of subcooling units in series, and joins the second refrigerant pipe, the subcooling expansion valve is disposed on the subcooling refrigerant pipe at a point between where the subcooling refrigerant pipe branches from the third refrigerant pipe and where the subcooling refrigerant pipe is first introduced into the plurality of subcooling units, and the plurality of subcooling units are provided so that the plurality of first branch refrigerant pipes respectively pass through the plurality of subcooling units so that a refrigerant, which passes through the first branch refrigerant pipes, exchange heat with a refrigerant, which passes through the subcooling refrigerant pipe.

2. The multi-type air conditioner of claim 1, wherein the outdoor unit comprises a compressor to compress a refrigerant, the outdoor heat exchanger to exchange heat with outdoor air, and an outdoor heat expansion valve to expand a refrigerant under decompression before the refrigerant is introduced into the outdoor heat exchanger, and wherein each of the plurality of indoor units comprises the indoor heat exchanger configured to exchange heat with indoor air and an indoor expansion valve, and are configured to expand a refrigerant under decompression before the refrigerant is introduced into the indoor heat exchanger.

3. The multi-type air conditioner of claim 2, wherein the first refrigerant pipe is configured to deliver a refrigerant of high temperature discharged from the compressor to the indoor heat exchangers, and the second refrigerant pipe is configured to guide a refrigerant, which has absorbed heat at the indoor heat exchangers, to the compressor.

4. The multi-type air conditioner of claim 3, wherein the mode conversion unit further comprises:

a cooling valve, configured to allow a refrigerant having passed through at least one of the indoor heat exchangers to be delivered to the second refrigerant pipe; and a heating valve, configured to allow a refrigerant having passed through the first refrigerant pipe to be delivered to at least one of the indoor heat exchangers.

5. The multi-type air conditioner of claim 3, further comprising:

a four-way valve configured to selectively guide a refrigerant, which has been discharged from the compressor, to one of the outdoor heat exchanger and the plurality of indoor units;

a fourth refrigerant pipe connecting the four-way valve to the outdoor heat exchanger;

a heating bypass refrigerant pipe connecting the first refrigerant pipe to the fourth refrigerant pipe; and a heating bypass valve configured to selectively open and close the heating bypass refrigerant pipe.

6. The multi-type air conditioner of claim 1, further comprising:

an outdoor expansion valve disposed on the outdoor unit, to expand a refrigerant under decompression before the refrigerant is introduced into the outdoor heat exchanger; and an indoor expansion valve disposed on each of the indoor units, to expand a refrigerant under decompression before the refrigerant is introduced into the indoor heat exchanger.

7. A multi-type air conditioner comprising:

a first unit comprising a first heat exchanger disposed in a first space;

a plurality of second units disposed in a second space, connected to the first unit through refrigerant pipes and comprising second heat exchangers, respectively; and a plurality of subcooling units configured to subcool a refrigerant, before the refrigerant is introduced into the second heat exchangers, wherein the refrigerant pipes comprise:

a first refrigerant pipe configured to deliver a refrigerant of a relatively high temperature, which is discharged from a compressor, to at least one of the second heat exchangers;

a second refrigerant pipe configured to guide a refrigerant, which has absorbed heat from at least one of the second heat exchangers, to the compressor;

a third refrigerant pipe configured to guide a refrigerant, which has emitted heat in at least one of the first heat exchanger and the second heat exchangers, to another one of the first heat exchanger and the second heat exchangers;

a subcooling refrigerant pipe which branches from the third refrigerant pipe and connects the plurality of subcooling units in series; and a plurality of first branch refrigerant pipes which branch from the third refrigerant pipe, to distribute the refrigerant, which is delivered through the third refrigerant pipe, into respective second heat exchangers, wherein the subcooling refrigerant pipe branches from the third refrigerant pipe at a point before the plurality of first branch refrigerant pipes branch from the third refrigerant pipe, the plurality of subcooling units are provided so that the plurality of first branch refrigerant pipes respectively pass through the plurality of subcooling units so that a refrigerant, which passes through the first branch refrigerant pipes, exchange heat with a refrigerant, which passes through the subcooling refrigerant pipe, the multi-type air conditioner further comprises a subcooling expansion valve disposed on the subcooling refrigerant pipe at a point between where the subcooling refrigerant pipe branches from the third refrigerant pipe and where the subcooling refrigerant pipe is first introduced into the plurality of subcooling units, and the subcooling expansion valve expands a refrigerant, which is introduced to the subcooling unit, under decompression.

8. The multi-type air conditioner of claim 7, further comprising at least one sensor disposed in a mode conversion unit which includes the plurality of subcooling units, to measure a temperature of the refrigerant passing through the subcooling refrigerant pipe and to determine a physical state of the refrigerant passing through the subcooling refrigerant pipe.

9. The multi-type air conditioner of claim 8, wherein the at least one sensor includes a first sensor to measure a temperature of refrigerant corresponding to an uppermost stream of the subcooling refrigerant pipe among the subcooling units, and a second sensor to measure a temperature of refrigerant corresponding to a downmost stream of the subcooling refrigerant pipe among the subcooling units.

10. The multi-type air conditioner of claim 9, wherein an opening degree of the subcooling expansion valve is adjusted based on the determined state of the refrigerant using at least one of the measurements from the first sensor and second sensor, to prevent refrigerant in a state of liquid from being introduced to the compressor via the second refrigerant pipe.

11. The multi-type air conditioner of claim 7, wherein when a second unit among the plurality of second units does not operate, a heat exchange is not performed between a corresponding one of the subcooling units among the plurality of subcooling units and the corresponding second unit which does not operate, and the refrigerant is delivered along the subcooling refrigerant pipe to a next subcooling unit among the plurality of subcooling units which are connected in series.

12. A mode-conversion unit disposed between a first unit and a plurality of second units of a multi-type air conditioner, the mode-conversion unit comprising:

a plurality of subcooling units, configured to subcool a refrigerant before the refrigerant is introduced to a plurality of second units;

a subcooling refrigerant pipe which connects the plurality of subcooling units in series; and a subcooling expansion valve disposed on the subcooling refrigerant pipe to expand a refrigerant before the refrigerant is introduced into the plurality of subcooling units, wherein the mode-conversion unit is connected to the first unit and the plurality of second units through a plurality of refrigerant pipes used to circulate the refrigerant between the first unit and the plurality of second units, wherein the plurality of refrigerant pipes comprise:

a first refrigerant pipe configured to deliver a refrigerant between the first unit and the plurality of second units, a second refrigerant pipe configured to guide a refrigerant from the plurality of second units to the first unit, a third refrigerant pipe configured to guide a refrigerant between a first heat exchanger disposed in the first unit, the mode-conversion unit, and second heat exchangers respectively disposed in the plurality of second units, and a plurality of first branch refrigerant pipes which branch from the third refrigerant pipe, to distribute the refrigerant, which is delivered through the third refrigerant pipe, into respective second heat exchangers, wherein the subcooling refrigerant pipe branches from the third refrigerant pipe at a point before the plurality of first branch refrigerant pipes branch from the third refrigerant pipe, connects the plurality of subcooling units in series, and joins the second refrigerant pipe, the subcooling expansion valve is disposed on the subcooling refrigerant pipe at a point between where the subcooling refrigerant pipe branches from the third refrigerant pipe and where the subcooling refrigerant pipe is first introduced into the plurality of subcooling units, and the plurality of subcooling units are provided so that the plurality of first branch refrigerant pipes respectively pass through the plurality of subcooling units so that a refrigerant, which passes through the first branch refrigerant pipes, exchange heat with a refrigerant, which passes through the subcooling refrigerant pipe.

13. The mode-conversion unit of claim 12, further comprising at least one sensor to measure a temperature of the refrigerant passing through the subcooling refrigerant pipe and to determine a physical state of the refrigerant passing through the subcooling refrigerant pipe.

14. The mode-conversion unit of claim 13, wherein the at least one sensor includes a first sensor to measure a temperature of refrigerant corresponding to an uppermost stream of the subcooling refrigerant pipe among the subcooling units, and a second sensor to measure a temperature of refrigerant corresponding to a downmost stream of the subcooling refrigerant pipe among the subcooling units.

15. The mode-conversion unit of claim 14, wherein an opening degree of the subcooling expansion valve is adjusted based on the determined state of the refrigerant using at least one of the measurements from the first sensor and second sensor, to prevent refrigerant in a state of liquid from being introduced to a compressor disposed in the first unit via the second refrigerant pipe which connects the mode-conversion unit to the first unit.

16. The mode-conversion unit of claim 12, wherein the first refrigerant pipe is configured to deliver a refrigerant discharged from a compressor disposed in the first unit, through the mode-conversion unit to at least one second heat exchanger disposed in a second unit among the plurality of second units, and the second refrigerant pipe is configured to guide a refrigerant, which has absorbed heat from at least one second heat exchanger disposed in a second unit among the plurality of second units, through the mode-conversion unit to the compressor.

17. A method of controlling refrigerant circulation in a multi-type air conditioner including a mode-conversion unit disposed between an external unit and a plurality of internal units, the method comprising:

receiving, by the mode-conversion unit from the external unit via a third refrigerant pipe, a refrigerant in a mixed state of liquid and gas;

expanding the refrigerant under decompression, by a subcooling expansion valve disposed on a subcooling refrigerant pipe at a point between where the subcooling refrigerant pipe branches from the third refrigerant pipe and where the subcooling refrigerant pipe is first introduced into a plurality of subcooling units;

subcooling, in at least one of the plurality of subcooling units, refrigerant passing through a first branch pipe which branches from the third refrigerant pipe and has been guided from the third refrigerant pipe to the first branch pipe, to a state of liquid, via a heat exchange with the subcooling refrigerant pipe; and heating refrigerant passing through the subcooling refrigerant pipe, via a heat exchange with the first branch pipe, wherein the expanding is performed before the subcooled refrigerant is introduced to the plurality of internal units, the subcooling refrigerant pipe branches from the third refrigerant pipe at a point before the first branch refrigerant pipes branch from the third refrigerant pipe, and connects the plurality of subcooling units in series, and the first branch pipe branches from the third refrigerant pipe to one of the plurality of internal units and the subcooling refrigerant pipe is disposed relative to the first branch pipe to perform the heat exchange with the first branch pipe.

18. The method of claim 17, further comprising:

measuring a temperature of the refrigerant passing through the subcooling refrigerant pipe using at least one sensor and determining a physical state of the refrigerant passing through the subcooling refrigerant pipe.

19. The method of claim 18, wherein the at least one sensor includes a first sensor to measure a temperature of refrigerant corresponding to an uppermost stream of the subcooling refrigerant pipe, and a second sensor to measure a temperature of refrigerant corresponding to a downmost stream of the subcooling refrigerant pipe, wherein the downmost stream of the subcooling refrigerant pipe is further from the subcooling expansion valve than the uppermost stream of the subcooling refrigerant pipe.

20. The method of claim 19, further comprising adjusting an opening degree of the subcooling expansion valve based on the determined state of the refrigerant using at least one of the measurements from the first sensor and second sensor, to prevent refrigerant in a state of liquid from being introduced to a compressor disposed in the external unit via a refrigerant pipe connecting the mode-conversion unit to the external unit.

* * * * *